US008066536B2

(12) United States Patent
Chen et al.

(10) Patent No.: US 8,066,536 B2
(45) Date of Patent: Nov. 29, 2011

(54) SPRING CONNECTOR

(75) Inventors: Yung-Yi Chen, Tu-Cheng (TW); Jui-Pin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 11 days.

(21) Appl. No.: 12/703,625

(22) Filed: Feb. 10, 2010

(65) Prior Publication Data

US 2011/0195616 A1 Aug. 11, 2011

(51) Int. Cl.
*H01R 13/24* (2006.01)

(52) U.S. Cl. ..... 439/824

(58) Field of Classification Search ..... 439/824, 439/700, 886, 482, 70, 66
See application file for complete search history.

(56) References Cited

U.S. PATENT DOCUMENTS 2,724,096 A * 11/1955 Klostermann ..... 439/824
7,021,976 B2 * 4/2006 Sekiguchi ..... 439/824
7,201,613 B2 * 4/2007 Sasaki ..... 439/700
7,507,110 B1 * 3/2009 Yin et al. ..... 439/482
7,690,925 B2 * 4/2010 Goodman ..... 439/70
2004/0161981 A1 * 8/2004 Matsui et al. ..... 439/824
2004/0224571 A1 * 11/2004 Yeh ..... 439/824
2006/0172613 A1 * 8/2006 Sasaki ..... 439/824

* cited by examiner

*Primary Examiner* — Alexander Gilman
(74) *Attorney, Agent, or Firm* — Cheng-Ju Chiang

(57) ABSTRACT

A spring connector includes a barrel, a plunger and a spring. The barrel includes a longitudinal space formed therein, an opening formed at a top thereof, a bottom plate formed at a bottom thereof and a narrow portion formed from a middle portion and to the bottom thereof. The plunger includes a contact portion protruding from the opening, a sliding portion received in the longitudinal space, and a limit recess formed in the lower sliding portion. A top end of the spring is received in and limited by the limit recess, and a bottom end and a middle portion is limited by the narrower portion to restrict the spring being compressed along a longitudinal direction thereof. The spring is also prevented from deviating from the longitudinal direction thereof.

4 Claims, 13 Drawing Sheets

SPRING CONNECTOR

BACKGROUND OF THE INVENTION

1. Field of the Invention

The invention relates to a spring connector, and more particularly to a spring connector with a limit means.

2. The Related Art

Please refer to FIG. 1. A conventional spring connector 900 includes a barrel 902, a plunger 904 and a coil spring 906. The barrel 902 has a cylindrical body 908, a bottom plate 910 sealed a bottom of the cylindrical body 908, a first shoulder 912 extended inward from a top of the cylindrical body 908 and a longitudinal space 914 formed therein. The first shoulder 912 is formed an opening 916 at a middle portion thereof. The bottom plate 10 extends outward to form a foot portion 918.

The plunger 904 includes an upper contact portion 920 and a lower sliding portion 922. The diameter of the lower sliding portion 920 is larger than the upper contact portion 18 to form a second shoulder 924 therebetween. A top of the upper contact portion 918 is formed a semi-spherical tip 926. The lower sliding portion 920 is formed a limit recess 928 opening at the bottom thereof. The top of the limit recess 926 is formed a slanting surface 930.

If the spring connector 900 is assembled, the lower sliding portion 922 of the plunger 904 will be received in the longitudinal space 914 of the barrel 902. The upper contact portion 920 of the plunger 904 protrudes upward from the opening 916 of the barrel 902. The coil spring 906 is of a longitudinal shape and is compressed in the longitudinal space 914. A top end of the coil spring 906 is received in the limit recess 928 of the sliding portion 922 of the plunger 904 and abutted against the slanting surface 930. A bottom end of the coil spring 906 abuts against a middle portion of the top surface of the bottom plate 910 positioned in the longitudinal space of the barrel 902.

The plunger 904 is biased to slide upward by the coil spring 906 in an extension position. The second shoulder 924 of the plunger 904 abuts against the first shoulder 912 of the barrel 902 to limit the upward movement of the plunger 904. If the spring connector 900 is used in a restricting position, the plunger 904 will be pressed to slide downward. The upper contact portion 920 of the plunger 904 is slid into the longitudinal space 914 of the barrel 902.

The coil spring 906 is vertically compressed along a longitudinal direction of the longitudinal space 914. Because the top end of the coil spring 906 abutted against the slanting surface 930 of the plunger 904, the plunger 904 is biased to be slanted and contacts to the barrel 902.

Because the top end of the coil spring 906 is received in and limited by the limit recess 928, the top end of the coil spring 906 is compressed along the longitudinal direction in the restricting position. The bottom end and a middle portion of the coil spring 906 is apt to be deviated away the longitudinal direction because there is not any limit means in a bottom portion of the longitudinal space 914 for limiting the bottom end of the middle portion of the coil spring 906. The elastic of the bottom end of the coil spring 906 will be apt to be fatigued after long-term used.

SUMMARY OF THE INVENTION

An object of the present invention is to provide a spring connector with a limit means.

According to the present invention, the spring connector includes a barrel, a plunger and a spring. The barrel includes a longitudinal space formed therein, a first shoulder extending inward from a top thereof, an opening formed at a middle portion of the first shoulder and connected to the longitudinal space, a bottom plate formed at a bottom thereof, a narrower portion formed from the bottom and to a middle thereof, and a third shoulder extending outwardly from a top of the narrower portion.

The plunger includes an upper contact portion protruding upward from the opening, a lower sliding portion received in the longitudinal space, a limit recess formed in the lower sliding portion and opened at a bottom surface of the lower sliding portion and connected to the longitudinal space, and a second shoulder formed between the upper contact portion and the lower sliding portion.

The spring is compressed in the longitudinal space, of which a top end portion is received in and limited by the limit recess of the plunger and a bottom portion and a middle portion is limited by the narrower portion. The movement of the lower sliding portion is limited between the first shoulder and the third shoulder.

As describe above, the top end portion of the spring is limited by the limit recess of the plunger, and the bottom end portion and the middle portion of the spring is limited by the narrower portion of the barrel to restrict the spring being compressed along a longitudinal direction thereof. In other words, the limit cylinder can prevent the spring from deviating away from the longitudinal direction. The movement of the plunger is limited between the first shoulder and the third shoulder of the barrel to prevent the coil spring from over compression.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
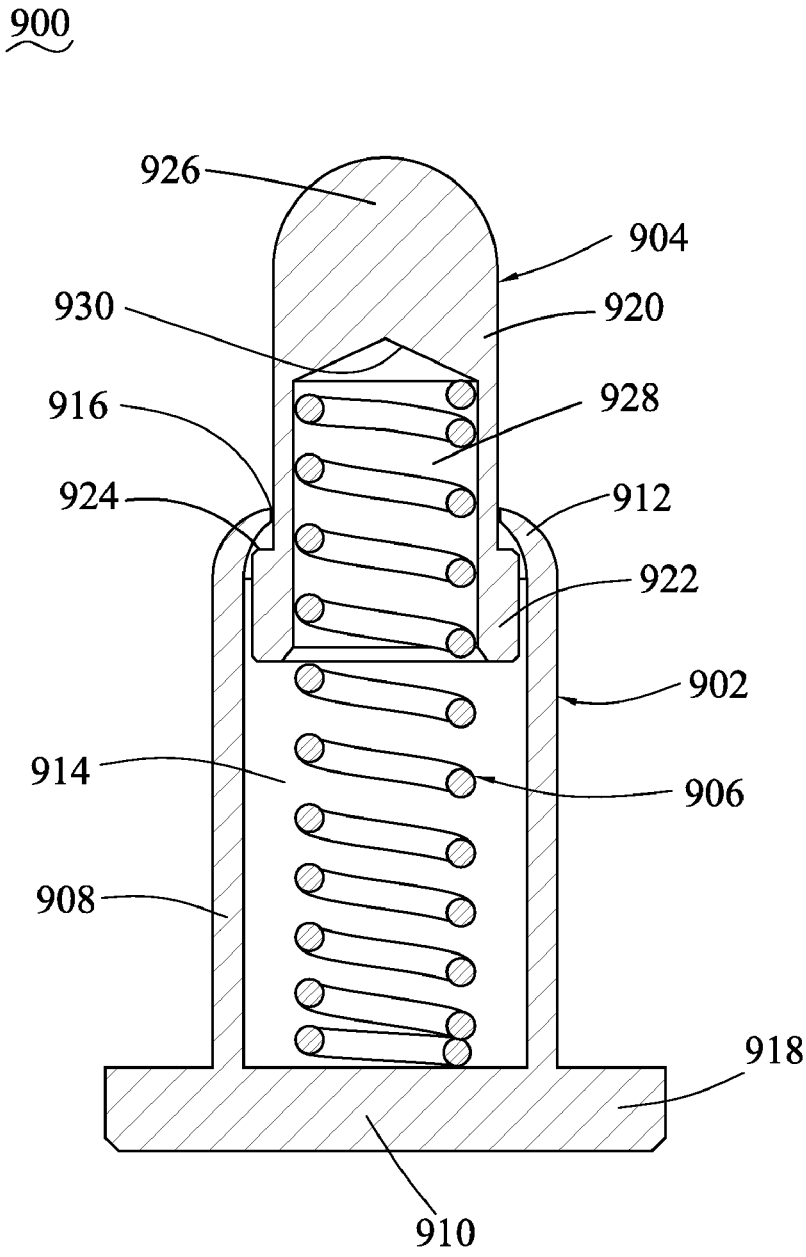
FIG. 1 (Prior Art)
FIG. 1 is a cross section view of a conventional spring connector.
Figure 2:
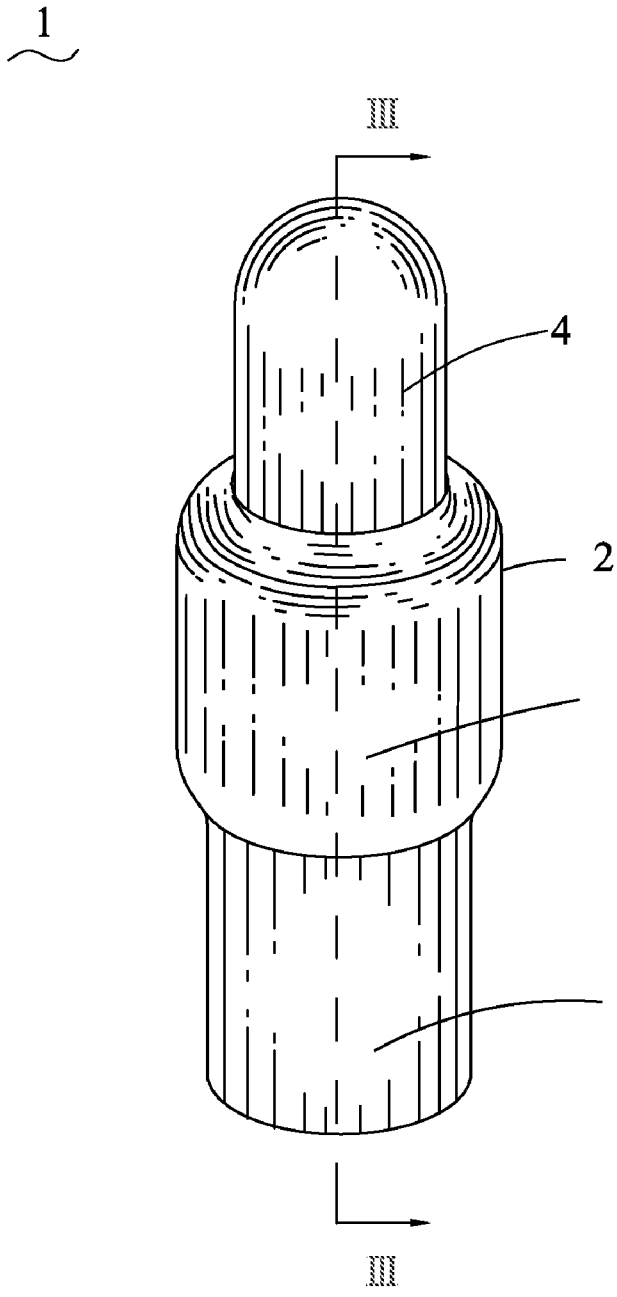
FIG. 2 is a perspective view of a first preferred embodiment of a spring connector according to the present invention.
Figure 3:
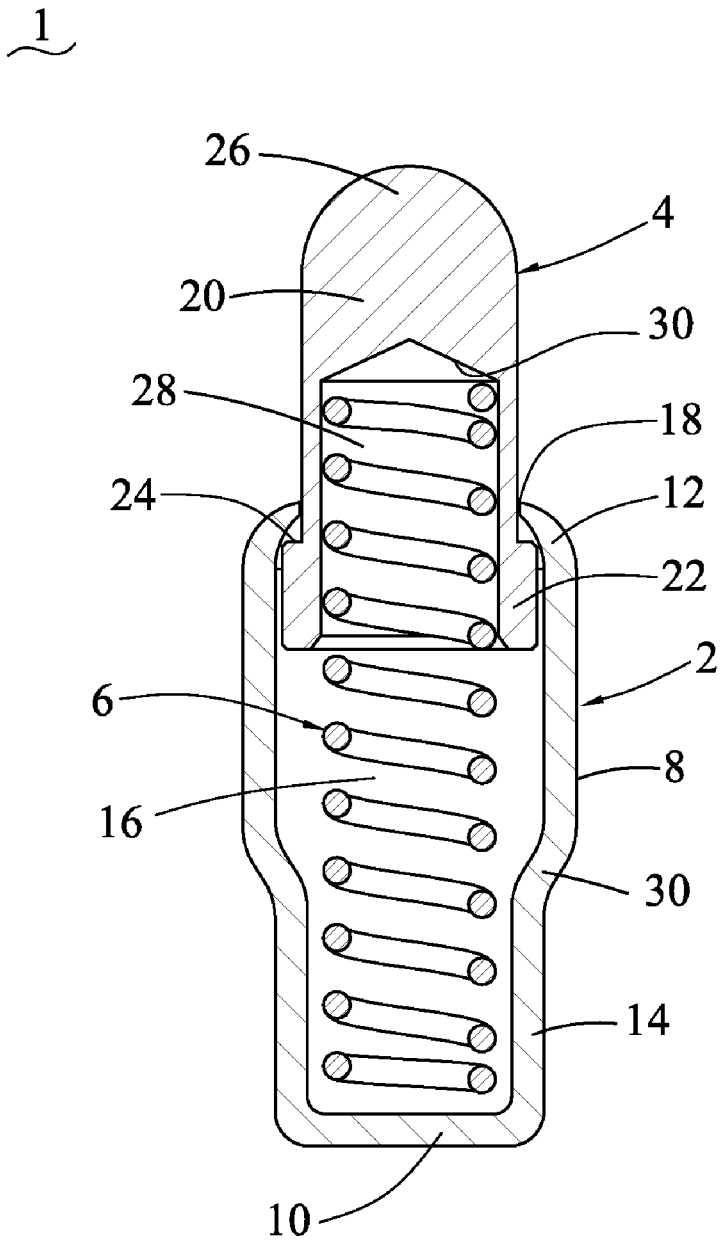
FIG. 3 is a cross section view of the spring connector along III-III in FIG. 2.
Figure 4:
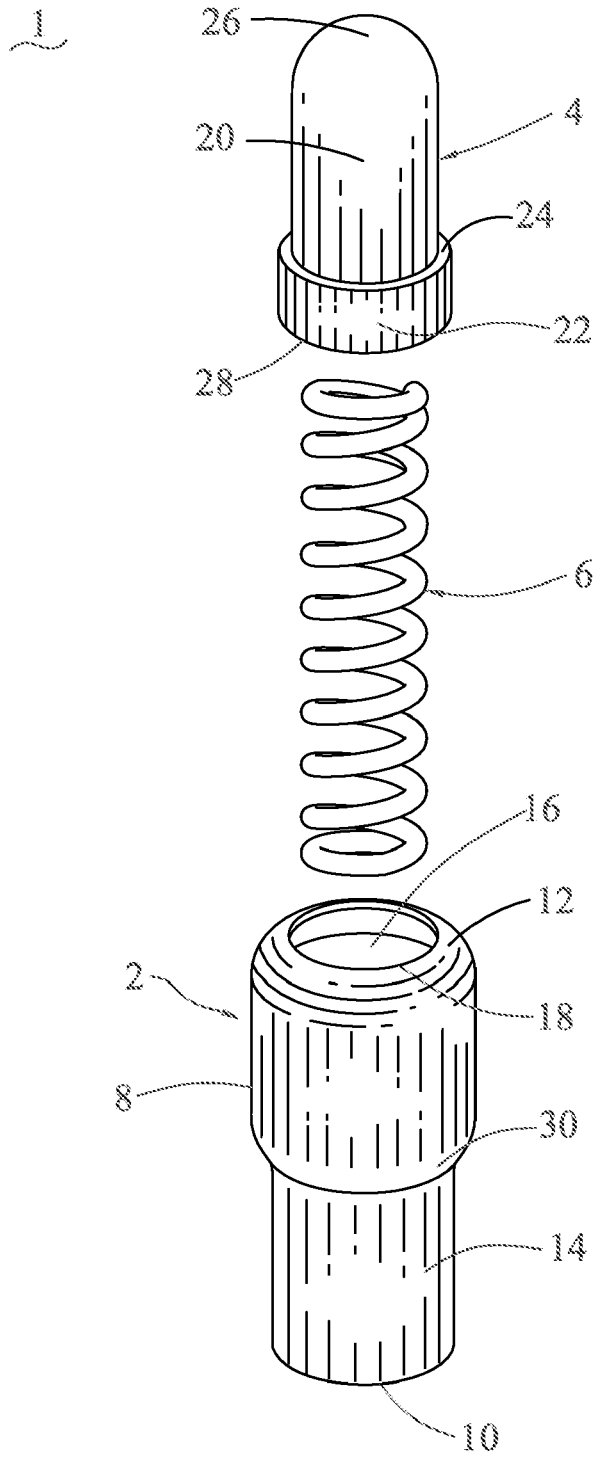
FIG. 4 is an exploded view of the spring connector shown in FIG. 2.

Please refer to FIG. 2 to FIG. 4. A first preferred embodiment of a spring connector 1 includes a barrel 2, a plunger 4 and a coil spring 6. The barrel 2 is formed as one piece and includes a cylindrical body 8, a bottom plate 10 and a first shoulder 12. The cylindrical body 8 includes a narrower portion 14 formed at a bottom thereof and is formed a longitudinal space 16 therein. Especially, the narrower portion 14 is of a cylindrical shape. The bottom plate 10 is extended from a bottom of the narrower portion 14 of the cylindrical body 8 and sealing the bottom of the narrower portion 14. The first shoulder 12 extends inward from a top of the cylindrical body 8. The first shoulder 12 is formed an opening 18 at a middle portion thereof. The opening 18 connects to the longitudinal space 16.

The plunger 4 includes an upper contact portion 20 and a lower sliding portion 22. The diameter of the lower sliding portion 22 is larger than the upper contact portion 20 to form a second shoulder 24 therebetween. A top of the upper contact portion 20 is formed as a semi-spherical tip 26. The lower sliding portion 22 is formed as a limit recess 28 opening at a bottom surface thereof. A top portion of the limit recess 28 is formed a slanting surface 30.

The inner diameter of the cylinder body 8 is large than an inner diameter of the narrower portion 14. The inner diameter of the narrower portion 14 is slightly larger than a diameter of the coil spring 6. The coil spring 6 is of a longitudinal shape. If the spring connector 1 is assembled, the lower sliding portion 22 of the plunger 4 will be received in the longitudinal space 16 of the barrel 2.

The limit recess 28 of the plunger 4 connects to the longitudinal space 16 of the barrel 2. The upper contact portion 20 of the plunger 4 protrudes upward from the opening 18 of the barrel 2. The coil spring 6 is compressed in the longitudinal space 16. A top end portion of the coil spring 6 is received in the limit recess 28 of the lower sliding portion 22 of the plunger 4 and abutted against the slanting surface 30. A bottom end portion of the coil spring 6 passes through the narrower portion 14 and abuts against the bottom plate 10. Especially, the bottom end portion of the coil spring 6 is laterally limited by the narrower portion 14 of the barrel 2.

The plunger 4 is biased to slide upward by the coil spring 6 in an extension position. The second shoulder 24 of the plunger 4 is biased to abut against the first shoulder 12 of the barrel 2 for limiting the upward movement of the plunger 4. If the spring connector 1 is used in a restricting position, the plunger 4 will be pressed by an external force to slide downward. The upper contact portion 20 of the plunger 4 is slid into the longitudinal space 16 of the barrel 2.

The coil spring 6 is vertically compressed along a longitudinal direction thereof. Because the top end portion of the coil spring 6 abutted against the slanting surface 30 of the plunger 4, the plunger 4 is biased to be slanted and contacts to the barrel 2. Because the top end portion of the coil spring 6 is received in and laterally limited by the limit recess 28 of the plunger 4, the top end portion of the coil spring 6 is compressed along the longitudinal direction in the restricting position. Because the bottom end portion of the coil spring 6 is laterally limited by narrower portion 14 of the barrel 2, the bottom end portion of the coil spring 6 is compressed along the longitudinal direction in the restricting position.

Especially, the barrel 2 is formed a third shoulder 32 extending outward from a top of the narrower portion 14. The third shoulder 32 is obliquely extending from the top of the narrower portion 14. The diameter of the lower sliding portion 22 of the plunger 4 is larger than the inner diameter of the third shoulder 32. Hence, the movement of the lower sliding portion 22 is limited between the first shoulder 12 and the third shoulder 32.

The narrower portion 14 of barrel 2 can prevent the coil spring 6 from deviating from the longitudinal direction. Therefore, the elastic of the coil spring 6 is prevented being fatigued after long-term used. The third shoulder 32 of the barrel 2 can limit the downward movement of the lower sliding portion 22 of the plunger 4 to prevent the coil spring 6 from being over compression.

Figure 5:
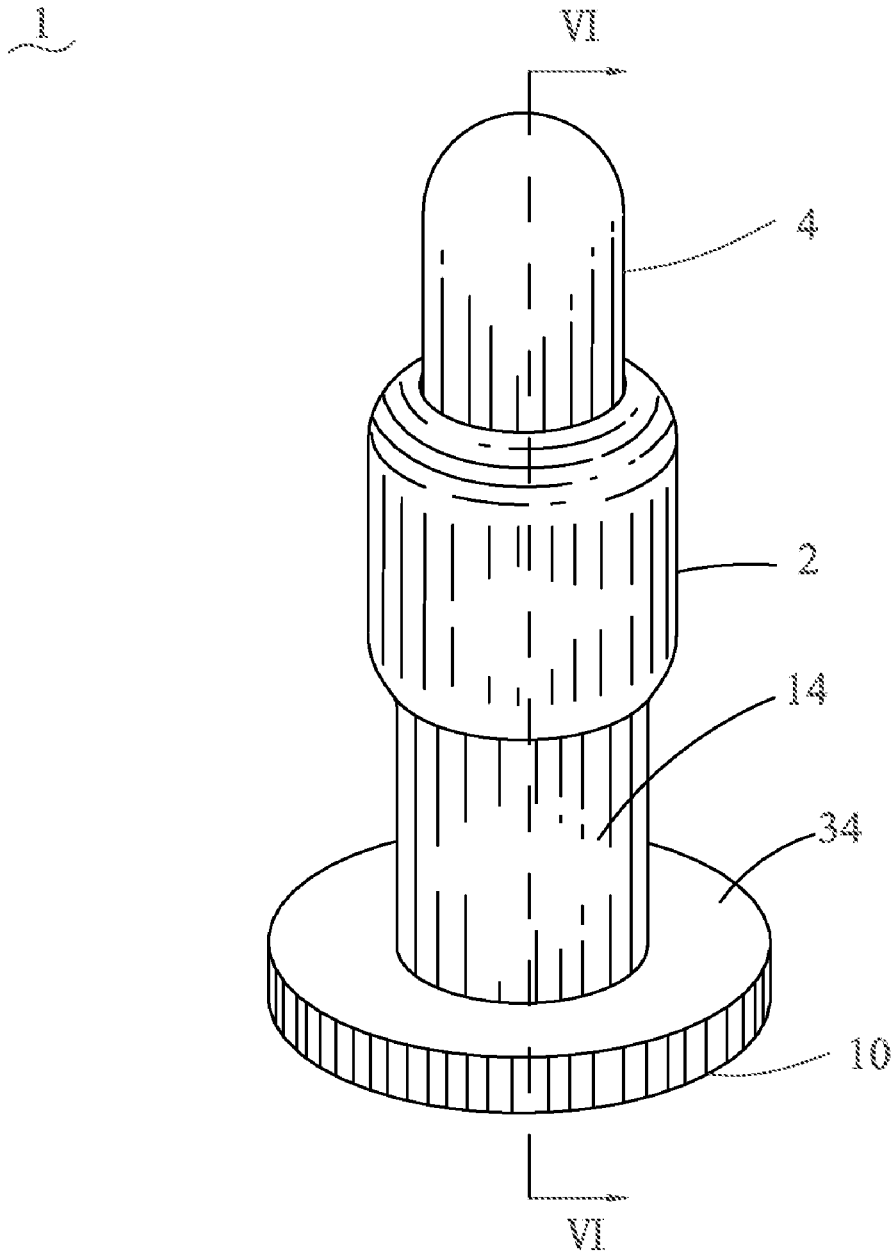
FIG. 5 is a perspective view of a second preferred embodiment of the spring connector according to the present invention.
Figure 6:
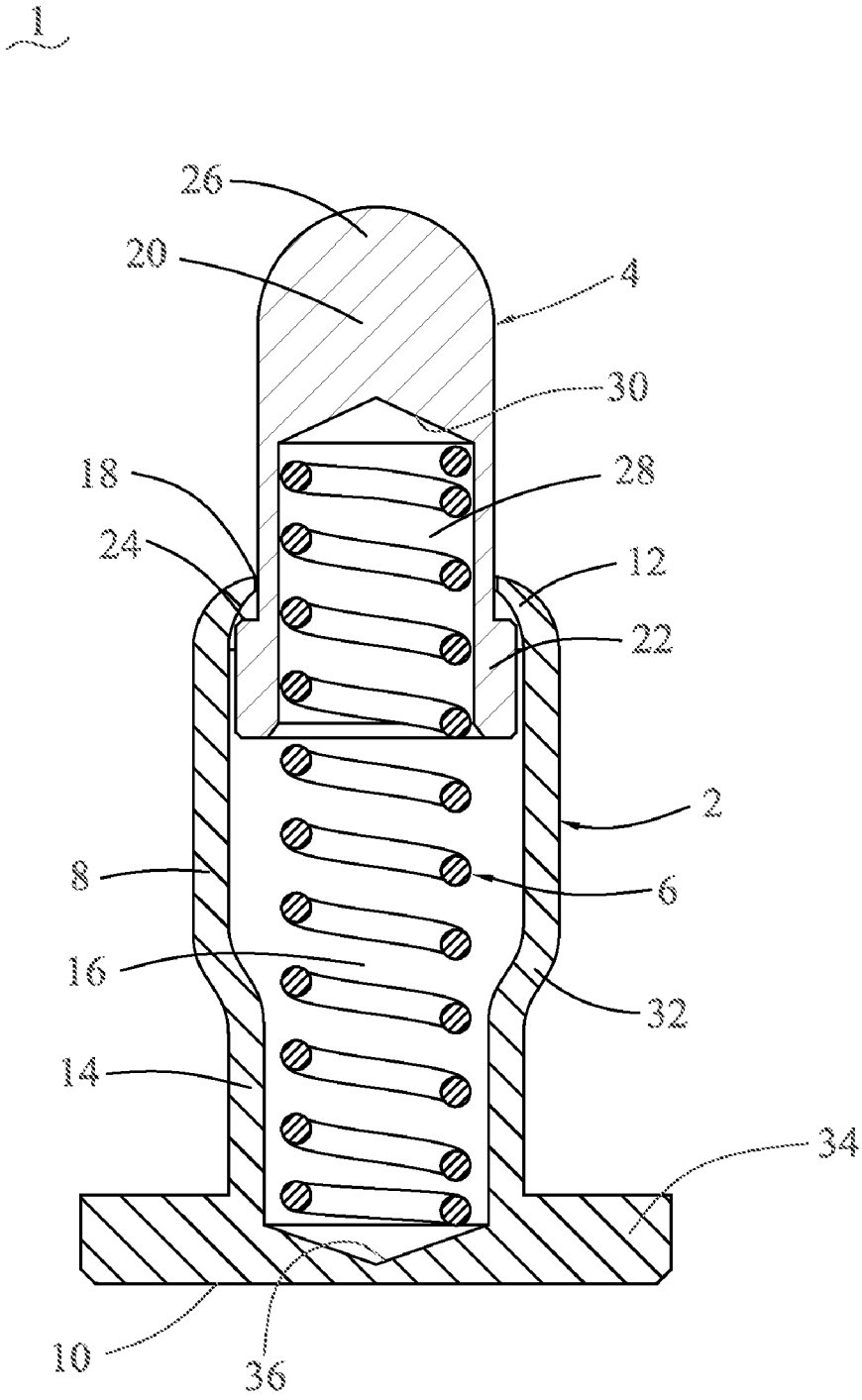
FIG. 6 is a cross section view of the spring connector along VI-VI in FIG. 5.
Figure 7:
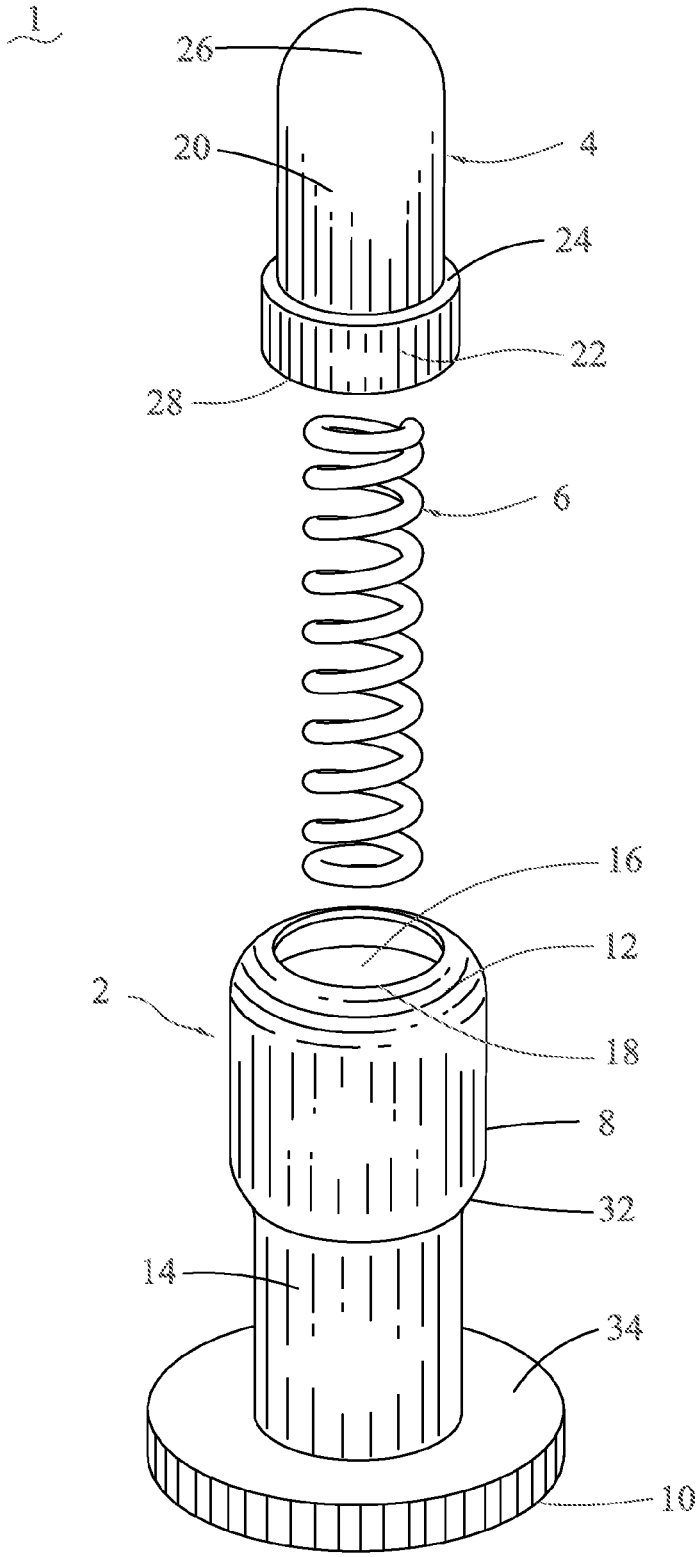
FIG. 7 is an exploded view of the spring connector in FIG. 5.

Please refer to FIG. 5 to FIG. 7. A second preferred embodiment of the spring connector 1 is similar to the first preferred embodiment. The difference therebetween is that the bottom plate 10 extends outward to form a foot portion 34 and forms a slanting concavity 36 at a middle portion of a top surface thereof and in the longitudinal space 16. The bottom end portion of the coil spring 6 abuts against the slanting concavity 36 of bottom plate 10 to urge the plunger 4 to be slanted and contacts to the barrel 2.

Figure 8:
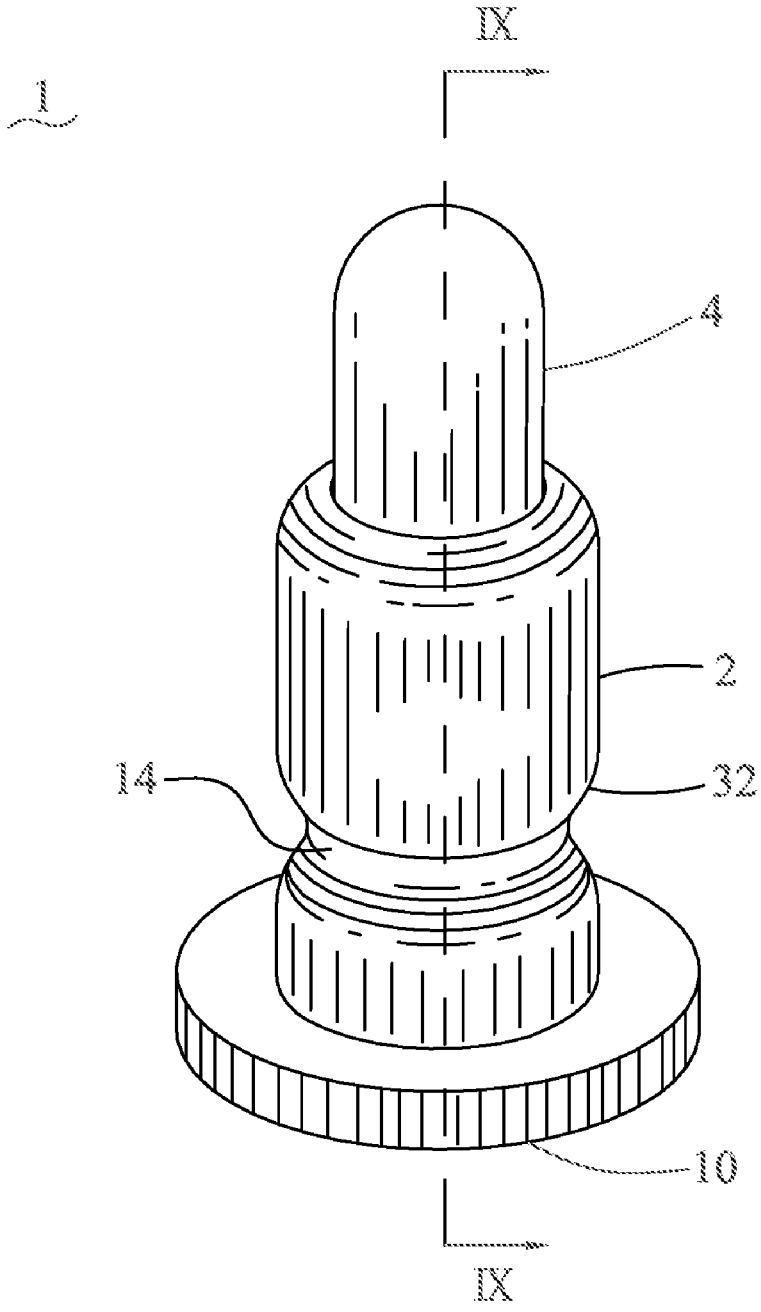
FIG. 8 is a perspective view of a third preferred embodiment of the spring connector according to the present invention.
Figure 9:
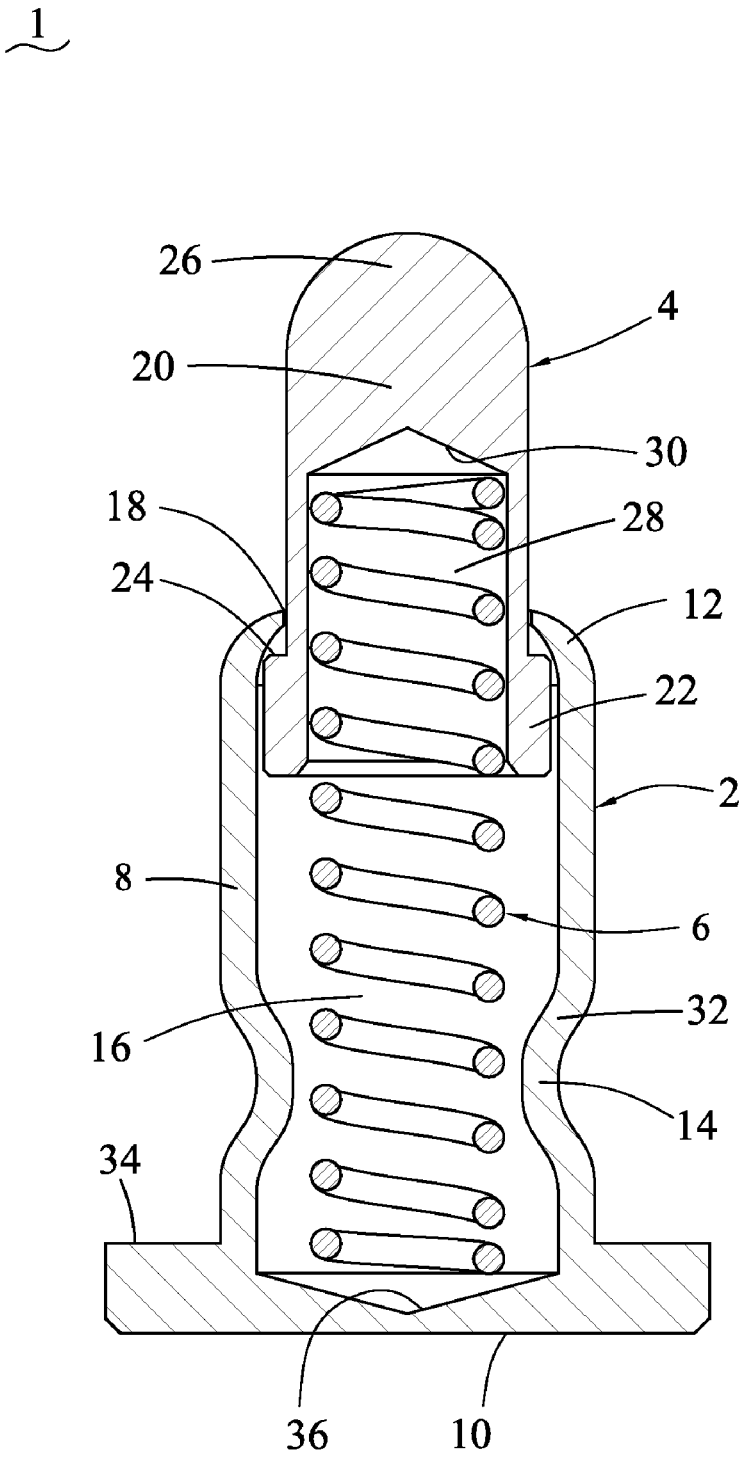
FIG. 9 is a cross section view of the spring connector along IX-IX in FIG. 8.
Figure 10:
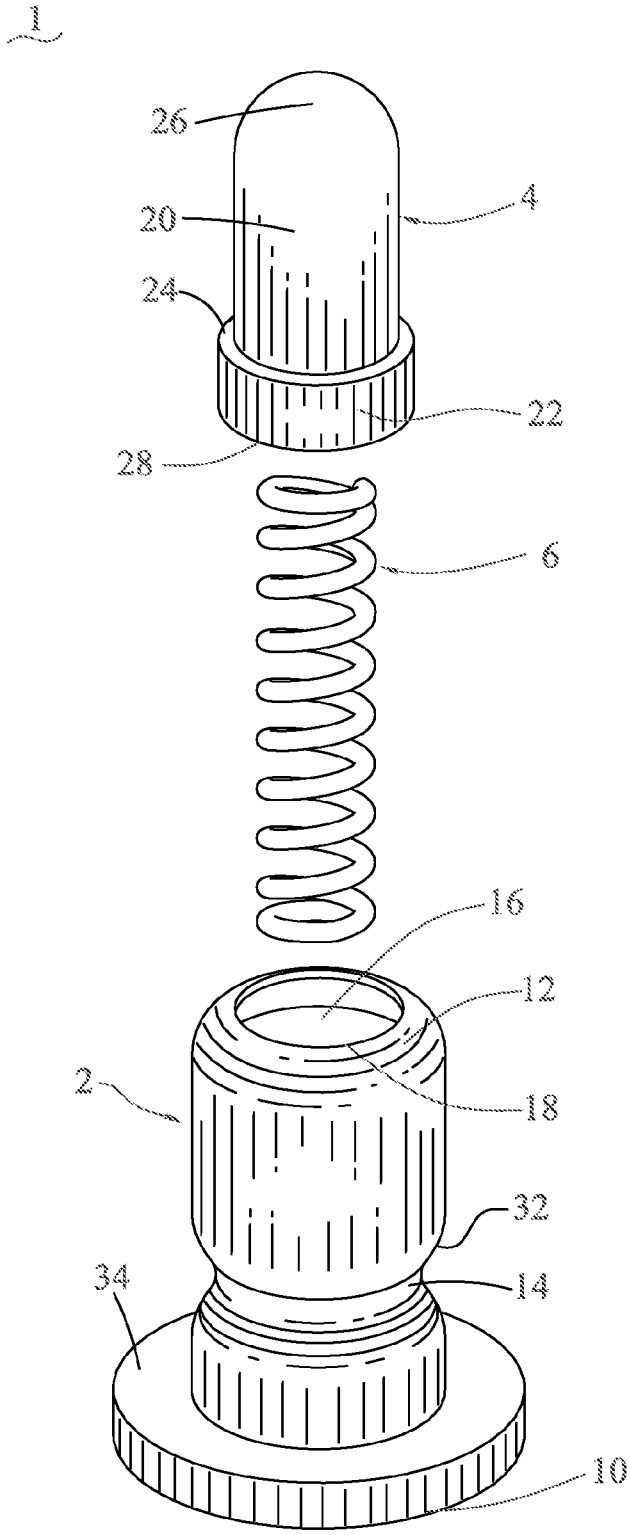
FIG. 10 is an exploded view of the spring connector in FIG. 8.

Please refer to FIG. 8 to FIG. 10. A third preferred embodiment of the spring connector 1 is similar to the first preferred embodiment. The difference therebetween is that the narrower portion 14 is formed at a middle portion of the barrel 2 to form a narrower waist. A middle portion of the coil spring 6 is laterally limited by the narrower waist 14 of the barrel 2.

Figure 11:
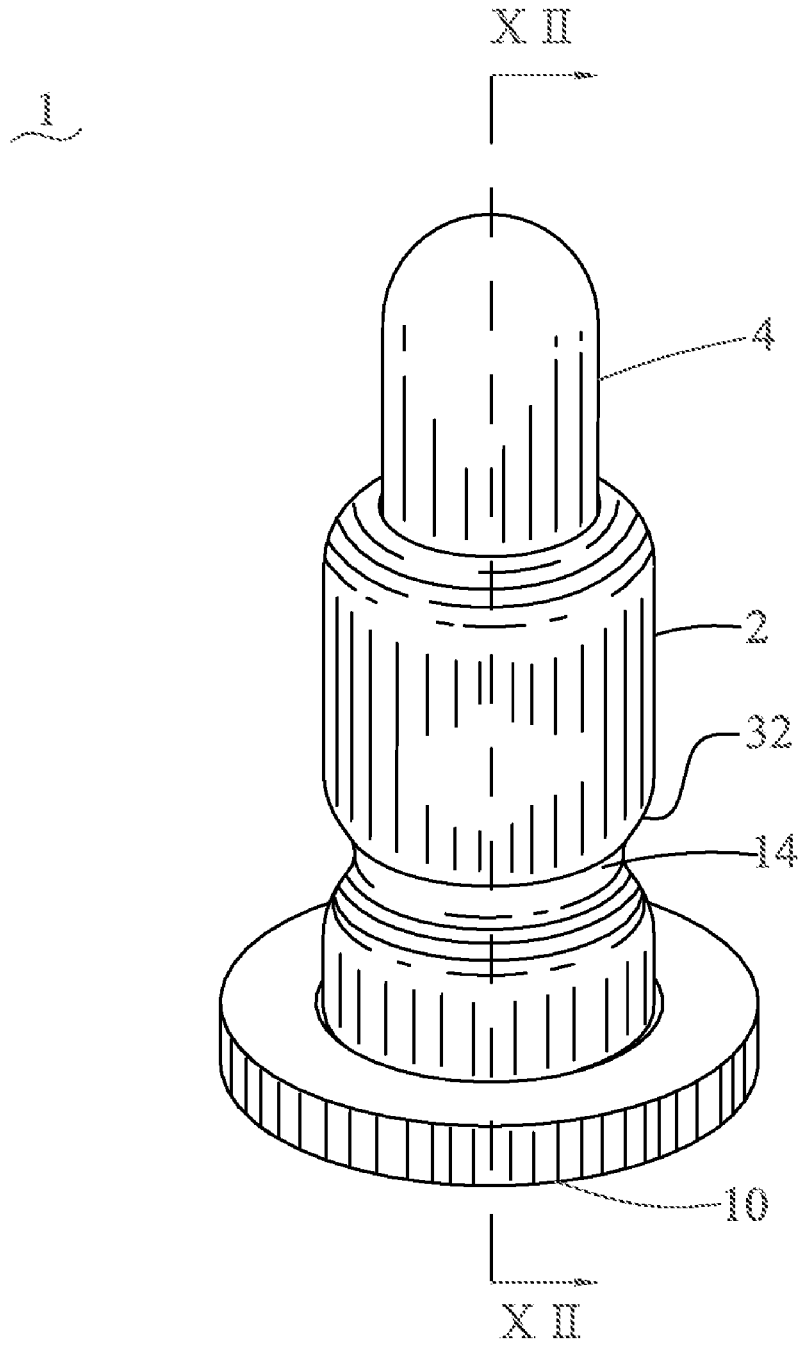
FIG. 11 is a perspective view of a fourth preferred embodiment of the spring connector according to the present invention.
Figure 12:
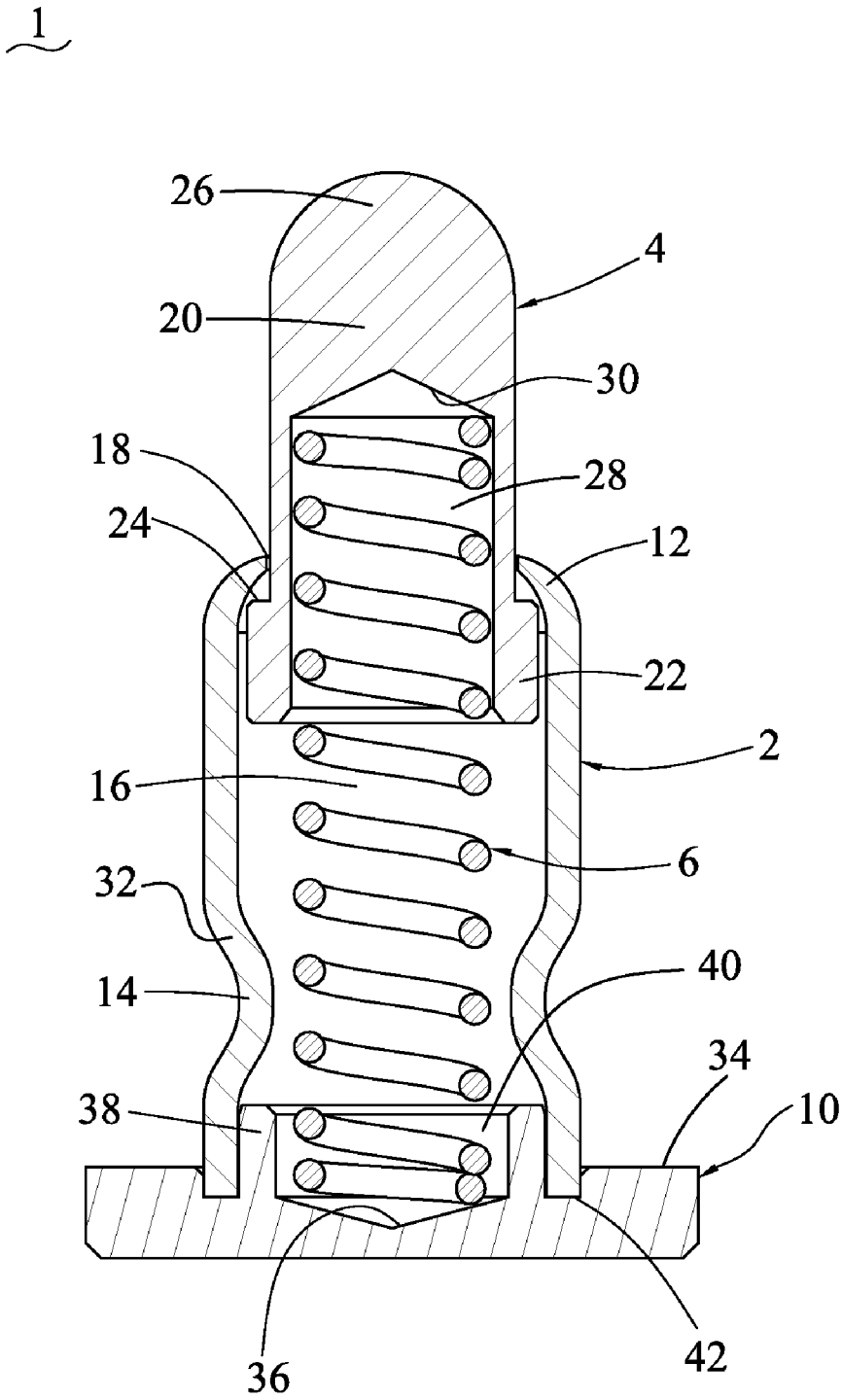
FIG. 12 is a cross section view of the spring connector along X II-X II in FIG. 11.
Figure 13:
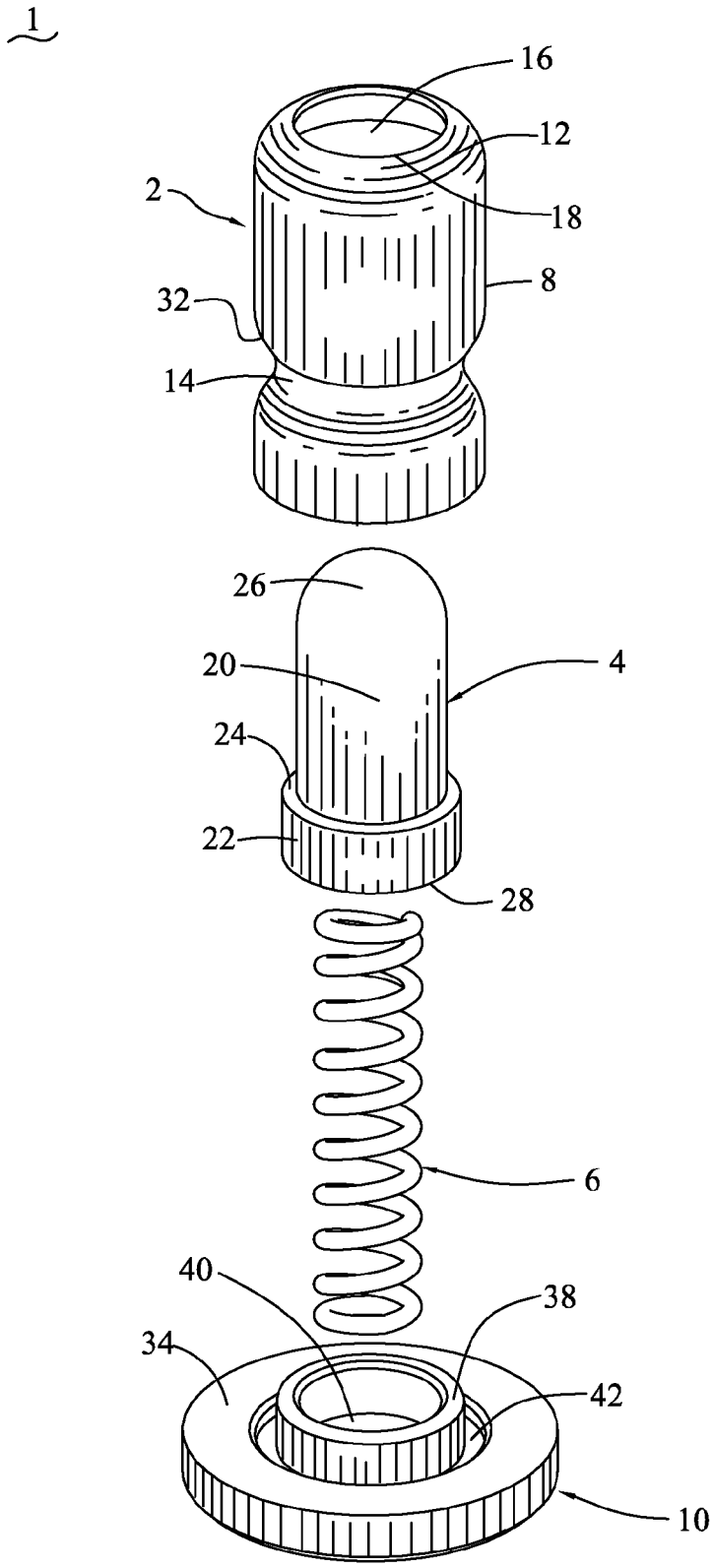
FIG. 13 is an exploded view of the spring connector in FIG. 11.

Please refer to FIG. 11 to FIG. 13. A fourth preferred embodiment of the spring connector 1 is similar to the third preferred embodiment. The difference therebetween is that the barrel 2 and the bottom plate 10 are formed as two pieces. The longitudinal space 16 is opening at the bottom of the barrel 2. The bottom plate 10 is formed a limit cylinder 38 at the middle portion of the top surface thereof. The limit cylinder 38 is formed a limit hole 40 therein and opening at a top thereof. The periphery of the limit cylinder 38 where the limit cylinder 38 connected to the bottom plate 10 is formed a ring groove 42. The slanting concavity 36 is formed in the limit hole 40.

The outer diameter of the limit cylinder 38 is substantially equal to the inner diameter of the cylindrical body 8 of the barrel 2. The inner diameter of the limit cylinder 38 is substantially equal to the inner diameter of the narrower waist 14. If the barrel 2 is assembled with the bottom plate 10, a bottom edge of the barrel 2 will be engaged into the ring groove 42. The limit cylinder 38 of the bottom plate 10 is received in the longitudinal space 16 of the barrel, and the limit hole 40 is connected to the longitudinal space 16.

The bottom end portion of the coil spring 6 is received in the limit hole 40 and is laterally limited by the cylindrical base 38. The bottom end portion of the coil spring 6 abuts against the slanting concavity 36 of the bottom plate 10. Hence, the middle portion of the coil spring 6 is laterally limited by the narrower waist 14 of the barrel 2, and the bottom end portion of the coil spring 6 is laterally limited by the limit cylinder 38 of the bottom plate 10.

Because the bottom end portion and the middle portion of the coil spring 6 are laterally limited by the narrower portion 14 of the barrel 2, the bottom end portion and the middle portion of the coil spring 6 are compressed along the longitudinal direction in the restricting position.

As describe above, the top end of the coil spring 6 is limited by the limit recess 28 of the plunger 4 and the bottom end of the coil spring 6 is limited by the narrower portion 14 of the barrel 2 to restrict the coil spring 6 being compressed along the longitudinal direction thereof. In other words, the narrower portion 14 of the barrel 2 can prevent the coil spring 6 from deviating from the longitudinal direction thereof. Therefore, the elastic of the coil spring 6 is prevented from being fatigued after long-term used. Because the movement of the lower sliding portion 22 is limited between the first shoulder 12 and the third shoulder 32, the coil spring 6 is prevented from over compression.

Furthermore, the present invention is not limited to the embodiment described above; various additions, alterations and the like may be made within the scope of the present invention by a person skilled in the art. For example, respective embodiments may be appropriately combined.

What is claimed is:

1. A spring connector, comprising:

a barrel comprising a longitudinal space formed therein, a first shoulder extending inward from a top thereof, an opening formed at a middle portion of the first shoulder and connected to the longitudinal space, and a bottom plate formed at a bottom thereof;

a plunger comprising an upper contact portion protruding upward from the opening, a lower sliding portion received in the longitudinal space, a limit recess formed in the lower sliding portion and opened at a bottom surface of the lower sliding portion and connected to the longitudinal space, and a second shoulder formed between the upper contact portion and the lower sliding portion; and a spring being compressed in the longitudinal space, of which a top end portion is received in and limited by the limit recess;

wherein at least one of the bottom and a middle portion of the barrel forms a narrower portion which forms a narrower waist when the narrower portion is formed at the middle portion of the barrel, a top of the narrower portion extends outward to form a third shoulder, a bottom end portion of the spring is limited by the narrower portion, and the movement of the lower sliding portion is limited between the first shoulder and the third shoulder.

2. The spring connector as claimed in claim 1, wherein the narrower portion is formed from the bottom to the middle portion of the barrel to form a cylindrical shape.

3. The spring connector as claimed in claim 1, wherein the bottom plate and the barrel are assembled, the longitudinal space is open at the bottom of the barrel, a middle portion of the bottom plate protrudes a limit cylinder which is formed a limit hole therein, the limit cylinder is received in the longitudinal space and positioned below the narrower waist for limiting the bottom end portion of the spring.

4. The spring connector as claimed in claim 3, wherein the periphery of the limit cylinder where the limit cylinder is connected to the bottom plate is formed a ring groove for being engaged with a bottom edge of the barrel.

* * * * *